US007583245B2

(12) United States Patent
Kwon

(10) Patent No.: US 7,583,245 B2
(45) Date of Patent: Sep. 1, 2009

(54) METHOD AND APPARATUS FOR DRIVING MEMORY OF LIQUID CRYSTAL DISPLAY DEVICE

(75) Inventor: Kyung Joon Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 644 days.

(21) Appl. No.: 10/878,124

(22) Filed: Jun. 29, 2004

(65) Prior Publication Data

US 2005/0140635 A1 Jun. 30, 2005

(30) Foreign Application Priority Data

Dec. 30, 2003 (KR) ..... 10-2003-0099810

(51) Int. Cl.
*G09G 3/36* (2006.01)
*G09G 5/36* (2006.01)

(52) U.S. Cl. ..... 345/98; 345/560

(58) Field of Classification Search ..... 345/204, 345/98, 99, 100, 560
See application file for complete search history.

(56) References Cited

U.S. PATENT DOCUMENTS 5,495,265 A 2/1996 Hartman et al.
6,304,254 B1 * 10/2001 Johnson et al. ..... 345/204
6,489,964 B1 * 12/2002 Van Asma ..... 345/545
2003/0231146 A1 * 12/2003 Lee et al. ..... 345/60
2004/0178984 A1 * 9/2004 Park et al. ..... 345/100
2007/0070019 A1 * 3/2007 Ham ..... 345/98

FOREIGN PATENT DOCUMENTS

KP 2003-0089072 A 11/2003
WO WO 99/05567 A1 2/1999

* cited by examiner

*Primary Examiner*—Amr Awad
*Assistant Examiner*—Randal Willis
(74) *Attorney, Agent, or Firm*—Birch, Stewart, Kolasch & Birch, LLP

(57) ABSTRACT

Systems, methods and apparatus provided for driving the memory of a liquid crystal display device that is capable of reducing the number of frame memories include the steps of storing a current frame data in an input line memory at a first speed; storing the data stored in the input line memory in a frame memory at a second speed faster than the first speed; storing a previous frame data stored in the frame memory in an output line memory at the second speed; and comparing the current frame data with the previous frame data, the previous frame data being outputted from the output line memory at the first speed and selecting a predetermined modulation data in accordance with the result of the comparison.

10 Claims, 9 Drawing Sheets

METHOD AND APPARATUS FOR DRIVING MEMORY OF LIQUID CRYSTAL DISPLAY DEVICE

This application claims the benefit of Korean Patent Application No. P2003-99810 filed in Korea on Dec. 30, 2003, the subject matter of which is hereby incorporated by reference in its entirety.

BACKGROUND OF THE INVENTION

1. Field of the Invention

The present invention relates to a liquid crystal display device, and more particularly, to a method and an apparatus for driving a memory of a liquid crystal display device capable of reducing the number of frame memories.

2. Description of the Related Art

In general, liquid crystal display devices control the light transmissivity of liquid crystal cells in accordance with video signals to display pictures.

In such liquid crystal display devices, an active matrix type of liquid crystal display device in which a switching device is formed in each liquid crystal cell is suitable for displaying motion pictures due to an active control. The switching device used in the active matrix type of liquid crystal display device generally is a thin film transistor (hereinafter referred to as a 'TFT').

A liquid crystal display device, as shown in the following formulas 1 and 2, has a disadvantage that its response time is slow due to its properties such as, for example, the unique viscosity and elasticity of a particular liquid crystal material.

$$\tau_r \propto \frac{\gamma d^2}{\Delta\varepsilon|V_a^2 - V_F^2|} \tag{1}$$

Where, $\tau_r$ represents the rise time of a voltage applied to the liquid crystal material, $V_a$ represents the applied voltage, $V_F$ represents a Freederick Transition Voltage due to liquid crystal molecules starting to make a tilt motion, d represents a cell gap of a liquid crystal cell, and $\gamma$ represents the rotational viscosity of a liquid crystal molecule.

$$\tau_f \propto \frac{\gamma d^2}{K} \tag{2}$$

Where, $\tau_f$ represents the decay time during which a liquid crystal material molecule is restored to its original, untilted position by elastic restoration after the voltage applied to the liquid crystal material is removed, and K represents a unique elastic modulus of the liquid crystal material.

The response speed of the liquid crystal material of a twisted nematic TN mode, which is a very widely used liquid crystal mode in liquid crystal display devices up to now, can be changed in accordance with the physical properties and the cell gap of the liquid crystal material, but generally its rise time is about 20 ms~80 ms and its decay time is about 20 ms~30 ms. The response speed of such a liquid crystal material extends to the next frame before the voltage being applied to the liquid cell reaches a desired voltage, as shown in FIG. 1, because the response speed is longer than one frame period (NTSC: 16.67 ms). Thus a motion-blurring phenomenon occurs so that the LC device screen gets blurred when the device displays motion pictures.

Referring to FIG. 1, in a related art liquid crystal display device, the display brightness BL does not reach a desired brightness, so desired color and brightness are not able to be expressed, wherein the display brightness corresponds to the change of data VD from one level to another level due to a slow response speed. As a result, the liquid crystal display device causes a motion-blurring phenomenon to appear in motion picture displays and its picture quality lowers due to a deterioration of contrast ratio.

In order to rectify the slow response speed of the liquid crystal display device, U.S. Pat. No. 5,495,265 and PCT international publication No. WO 99/05567 have introduced a scheme (hereinafter 'high speed driving method') in which data are modulated in accordance with the existence or absence of a change of the data by use of a look-up table. The high speed driving method modulates data according to the principles illustrated in FIG. 2.

Referring to FIG. 2, the related art high speed driving method modulates input data VD into predetermined modulation data MVD and applies the modulated data MVD to a liquid cell to achieve a desired brightness MBL. The high speed driving method achieves the value of $|V_a^2-V_F^2|$ in formula 1 on the basis of the existence or absence of a change of the data in order to achieve a desired brightness corresponding to the brightness value of the input data within one frame period. As a result, the liquid crystal display device using the high speed driving method compensates the slow response speed of liquid crystal material by modulating the data value to reduce the motion-blurring phenomenon in motion pictures display.

In other words, the high speed driving method compares data between a previous frame and a current frame. If the data is changed, then the high speed driving method modulates data of the current frame into the predetermined modulation data. A high speed driving apparatus implemented in this way can be implemented as in FIG. 3.

Referring to FIG. 3, the high speed driving method includes a first and a second frame memory 43*a* and 43*b*, respectively, for storing data from an input data line 42, and a modulator 44 to modulate data.

The first and the second frame memories 43*a* and 43*b* alternately store data of a frame unit in accordance with a pixel clock and then alternately output the stored data to supply a previous frame data, i.e., (n−1)th frame data fn−1 to the modulator 44.

The modulator 44 compares an (n)th frame data Fn from a data input line 43 and a (n−1)th frame data Fn−1 from the first and the second frame memories 43*a* and 43*b*, and then selects modulation data MRGB corresponding to the comparison result from a look-up table such as Table 1 to modulate the data. The look-up table may be stored in a read only memory ROM.

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |

TABLE 1-continued

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 3 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 14 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 13 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

In table 1, the leftmost column represents the data of the previous frame Fn−1 and the uppermost row represents the data of the current frame Fn.

During an (n)th frame period, as represented by a solid line in FIG. 3, the (n)th frame data Fn is stored in the first frame memory 43*a* and is also supplied to the modulator 44 pursuant to the pixel clock. At the same time, for a (n)th frame period, the second frame memory 43*b* supplies the (n−1)th frame data Fn−1 to the modulator 44.

On the other hand, for a (n+1)th frame period, as represented by a dotted line in FIG. 3, the (n+1)th frame data Fn+1 is stored in the second frame memory 43*b* and is also supplied to the modulator 44 pursuant to the pixel clock. At the same time, for a (n+1)th frame period, the first frame memory 43*b* supplies the (n)th frame data Fn to the modulator 44.

As described above, the high speed driving method requires two frame memories 43*a* and 43*b* in order to alternately supply the previous frame data to the modulator 44. Because the frame memory is a cause of increasing circuit expense, a scheme capable of reducing the number of frame memories or the capacitance of the frame memory is desired.

SUMMARY OF THE INVENTION

Accordingly, it is an object of the present invention to provide a method and an apparatus for driving the memory of a liquid crystal display device capable of reducing the number of frame memories and improving display quality by making the response speed of a liquid crystal material fast.

In order to achieve these and other objects of the invention, a method and apparatus for driving the memory of a liquid crystal display device according to an embodiment of present invention includes: storing current frame data in an input line memory at a first speed; storing the data stored in the input line memory in a frame memory at a second speed faster than the first speed; storing a previous frame data stored in the frame memory in an output line memory at the second speed; and comparing the current frame data with the previous frame data, the previous frame data being outputted from the output line memory at the first speed, and selecting predetermined modulation data in accordance with the result of the comparison.

The first speed is a one-pixel clock rate and the second speed is a two-pixel clock rate that is twice as high as the rate of the one-pixel clock rate.

The step of storing the current frame data in the input line memory at the first speed includes: storing odd-numbered line data of the current frame data in a fist input line memory at the first speed during an odd-numbered line period; and storing even-numbered line data of the current frame data in a second input line memory at the first speed during an even-numbered line period.

The step of storing the data stored in the input line memory at the second speed in the frame memory includes: storing the odd-numbered line data of the current frame data stored in the first input line memory in the frame memory during ½ of the period of the even-numbered line period; and storing the even-numbered line data of the current frame data stored in the second input line memory in the frame memory during ½ of the period of the odd-numbered line period.

The step of storing the previous frame data stored in the frame memory in the output line memory at the second speed includes: storing the odd-numbered line data of the previous frame data, stored in the frame memory, in a first output line during the even-numbered line period; and storing the even-numbered line data of the previous frame data, stored in the frame memory, in a second output line during the odd-numbered line period.

The method further includes the step of synchronizing the current frame data and the previous frame data by delaying the current frame data.

An apparatus for driving a memory in a liquid crystal display device according to an exemplary embodiment of the present invention includes: an input line memory for storing a current frame data at a first speed and outputting the stored data at a second speed faster than the first speed; an output line memory for storing a previous frame data at the second speed and outputting the stored data at the first speed; a frame memory for storing the current frame data from the input line memory at the second speed and supplying the previous frame data to the output line memory at the second speed; and a modulator for comparing the current frame data with the previous frame data from the output line memory and selecting a predetermined modulation data in accordance with the result of the comparison.

The apparatus further includes a frequency multiplier for multiplying a pixel clock at the one-pixel clock rate to generate a two-pixel clock rate having a frequency twice as high as the rate of the one-pixel clock.

The input line memory includes: a first input line memory for storing an odd-numbered line data of the current frame data at the first speed during an odd-numbered line period and supplying the odd-numbered line data of the current frame data at the second speed to the frame memory during ½ of an even-numbered line period; and a second input line memory for storing an even-numbered line data of the current frame data at the first speed during the even-numbered line period and supplying the even-numbered line data of the current frame data at the second speed to the frame memory during ½ of the odd-numbered line period.

The first and the second input line memories alternately input/output the data.

The output line memory includes: a first output line memory for storing the odd-numbered line data of the previous frame data at the second speed during the even-numbered line period and supplying the stored odd-numbered line data of the previous frame data at the first speed to the modulator; and a second output line memory for storing the even-numbered line data of the previous frame data at the second speed during the odd-numbered line period and supplying the stored even-numbered line data of the previous frame data at the first speed to the modulator.

The first and the second output line memories alternately input/output the data.

The apparatus further includes a delay circuit for delaying the current frame data to synchronize the frame data and the previous frame data.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawing.

Hereinafter, the exemplary embodiments of the present invention will be described in detail with reference to FIGS. 4 to 8.

Figure 1:
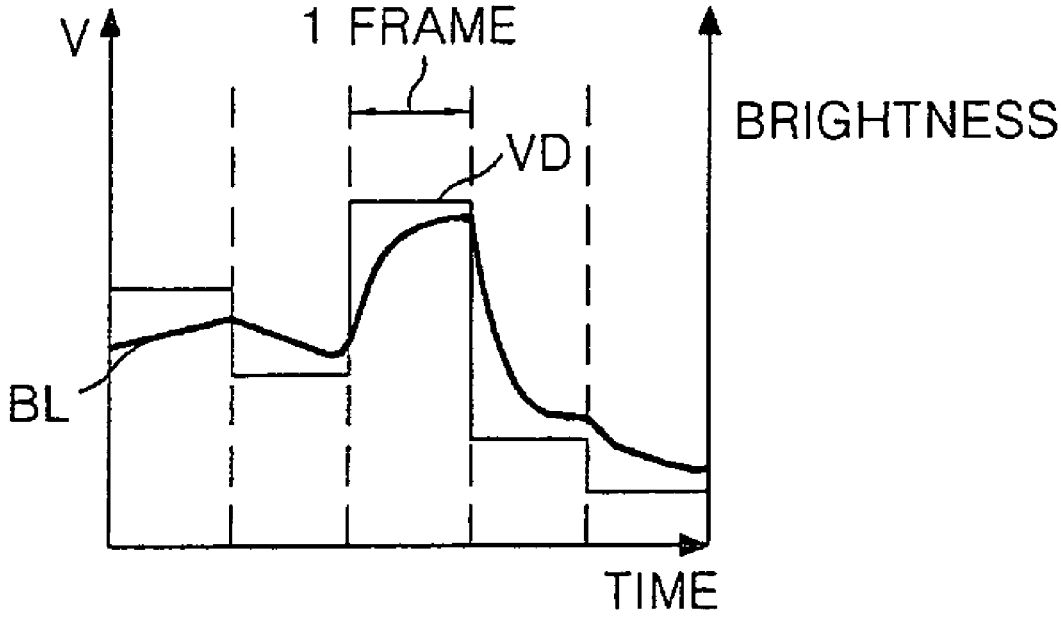
FIG. 1 RELATED ART
FIG. 1 is a waveform representing a change of brightness according to data in a related art liquid crystal display device.
Figure 2:
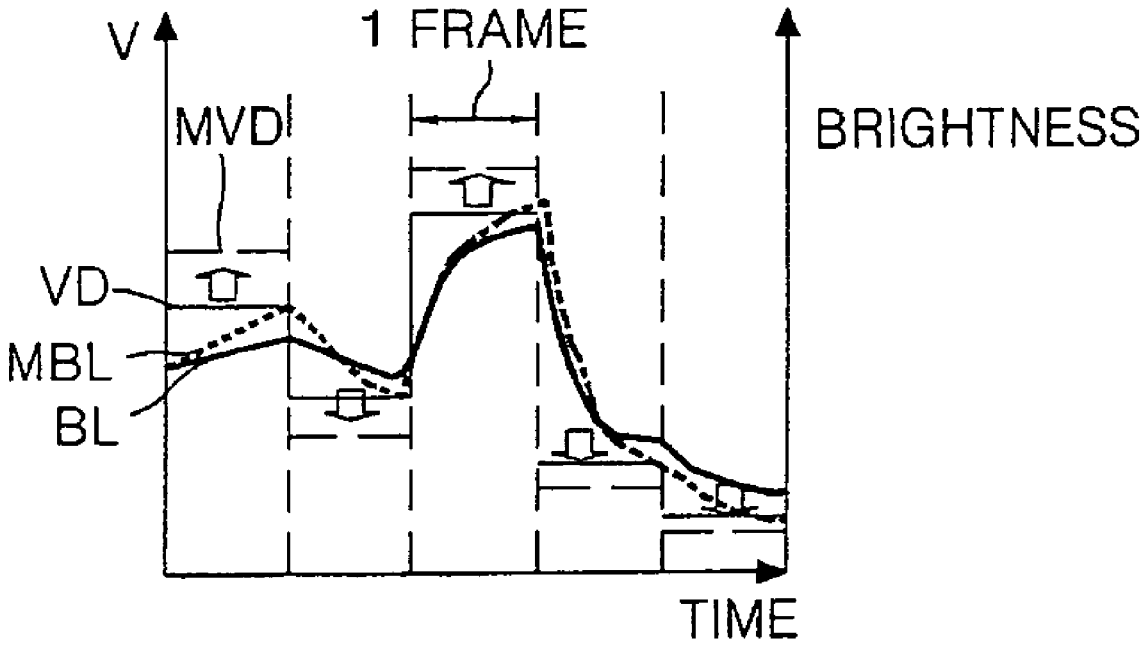
FIG. 2 RELATED ART
FIG. 2 is a waveform representing a change of brightness according to a data modulation in a high speed driving method.
Figure 3:
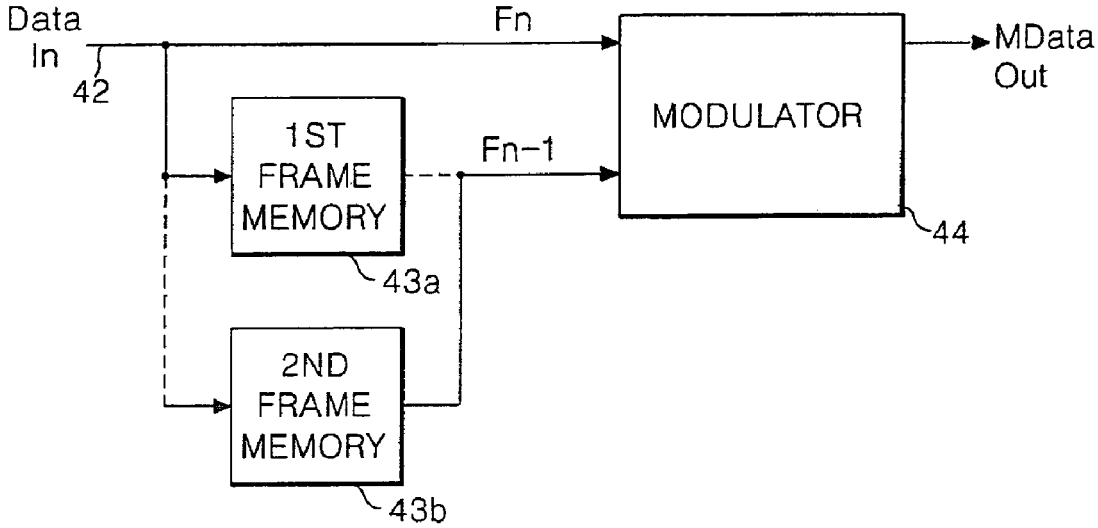
FIG.3 RELATED ART
FIG. 3 is an exemplary configuration of a high speed driving device.
Figure 4:
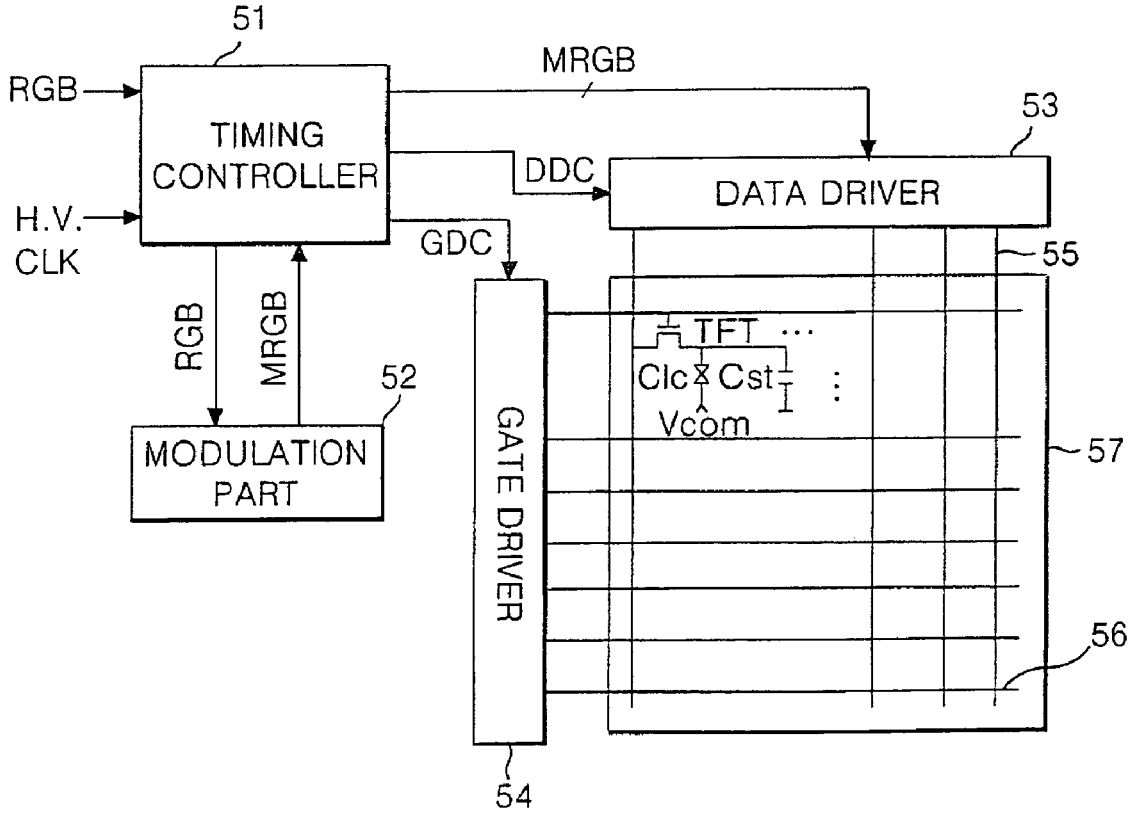
FIG. 4 is a block diagram representing a liquid crystal display device according to an exemplary embodiment of the present invention.

Referring to FIG. 4, a liquid crystal display device according to an embodiment of the present invention includes: a liquid crystal display panel 57 in which TFTs, thin film transistors, to drive liquid crystal cells Clc are formed at intersections of data lines 55 and gate lines 56; a data driver 53 to supply data to the data lines 55 of the liquid crystal display panel 57; a gate driver 54 to supply scan pulses to the gate lines 56 of the liquid crystal display panel 57; a modulating part 52 to modulate RGB data into a predetermined MRGB modulation data; and a timing controller 51 to control the data driver 53 and the gate driver 54 and to supply data RGB to the modulating part 52.

In various exemplary embodiments of the systems and methods of the invention, the liquid crystal display panel 57 has liquid crystal materials injected between two glass substrates, e.g., an upper glass substrate and a lower glass substrate, and the data lines 55 and the gate lines 56 are formed to cross each other on the lower glass substrate. The TFTs supply data from the data lines 55 to the liquid crystal cells, Clc, in response to scan pulses from the gate lines 56. To achieve this, a gate electrode of each of the TFTs is connected to each of the gate lines 56 and a source electrode is connected to each of the data lines 55, respectively. Also, a drain electrode of each of the TFTs is connected to a pixel electrode of each of the liquid crystal cells Clc. Also, a storage capacitor Cst is formed on the lower glass substrate of the liquid crystal display panel 57 to sustain the voltage of the liquid crystal cell Clc. The storage capacitor Cst can be formed between the liquid crystal cell Clc connected to the gate line 56 of a previous stage, or can be formed between the liquid crystal cell, Clc, and a separate common line.

The data driver 53 includes: a shift register; a register for temporarily storing modulation data MRGB; a latch to store the data by a line unit in response to clock signals from the shift register and to output the stored data by one line unit simultaneously; a digital-analog converter to select gamma compensation voltage of positive/negative polarity in response to the digital data value from a latch; a multiplexer to select the data line 55 to which the gamma voltage of positive/negative polarity is supplied; and an output buffer connected between the multiplexer and the data line 55. The data driver 53 receives the MRGB modulation data from the timing controller 51 and supplies the MRGB modulation data to the data lines 55 of the liquid crystal display panel 57 under control of the timing controller 51.

The gate driver 54 includes a shift register to sequentially generate scan pulses in response to gate control signals GDC from the timing controller 51, a level shifter to shift a swing width of the scan pulse to a level suitable for driving the liquid crystal cell Clc, and an output buffer. The gate driver 54 supplies the respective scan pulses to the gate line 56 to turn-on the TFT connected to the gate line 56, thereby selecting the liquid crystal cell Clc of one horizontal line to which the analog gamma compensation voltage, i.e., a pixel voltage of data will be supplied. The data generated from the data driver 53 is synchronized with the scan pulse to be supplied to the liquid crystal cell, Clc, of the selected one horizontal line.

The timing controller 51 generates gate control signal GDC to control the gate driver 54 and a data control signal DDC to control the data driver 53 in use of vertical/horizontal synchronization signals V, H and a pixel clock CLK. The timing controller 51 samples RGB digital video data in accordance with the pixel clock CLK and supplies the RGB data to the modulatation part 52.

Based on a change of data value between a previous frame and a current frame, the modulating part 52 modulates RGB data by using modulation data predetermined based on Formulas 3 to 5, below, and supplies the MRGB modulation data to the timing controller 51. The modulation data MRGB is registered in the look-up table stored in the ROM.

$$Fn(RGB)<Fn-1(RGB)\rightarrow Fn(MRGB)<Fn(RGB) \quad (3)$$

$$Fn(RGB)=Fn-1(RGB)\rightarrow Fn(MRGB)=Fn(RGB) \quad (4)$$

$$Fn(RGB)>Fn-1(RGB)\rightarrow Fn(MRGB)>Fn(RGB) \quad (5)$$

As can be seen from Formulas 3 to 5, if a pixel data value of a pixel in the current frame Fn becomes larger than that of the pixel in the previous frame Fn−1, then the MRGB modulation data will have a larger value than the pixel data in the current frame Fn. On the other hand, if the pixel data value of a pixel in the current frame Fn becomes smaller than that of the pixel in the previous frame Fn−1, then the MRGB modulation data will have a smaller value than the pixel data in the current frame Fn. Moreover, if a pixel data value of a pixel has the same value in the current frame Fn and the previous frame Fn−1, then the MRGB modulation data will have the same value as the pixel data in the current frame Fn.

Figure 5:
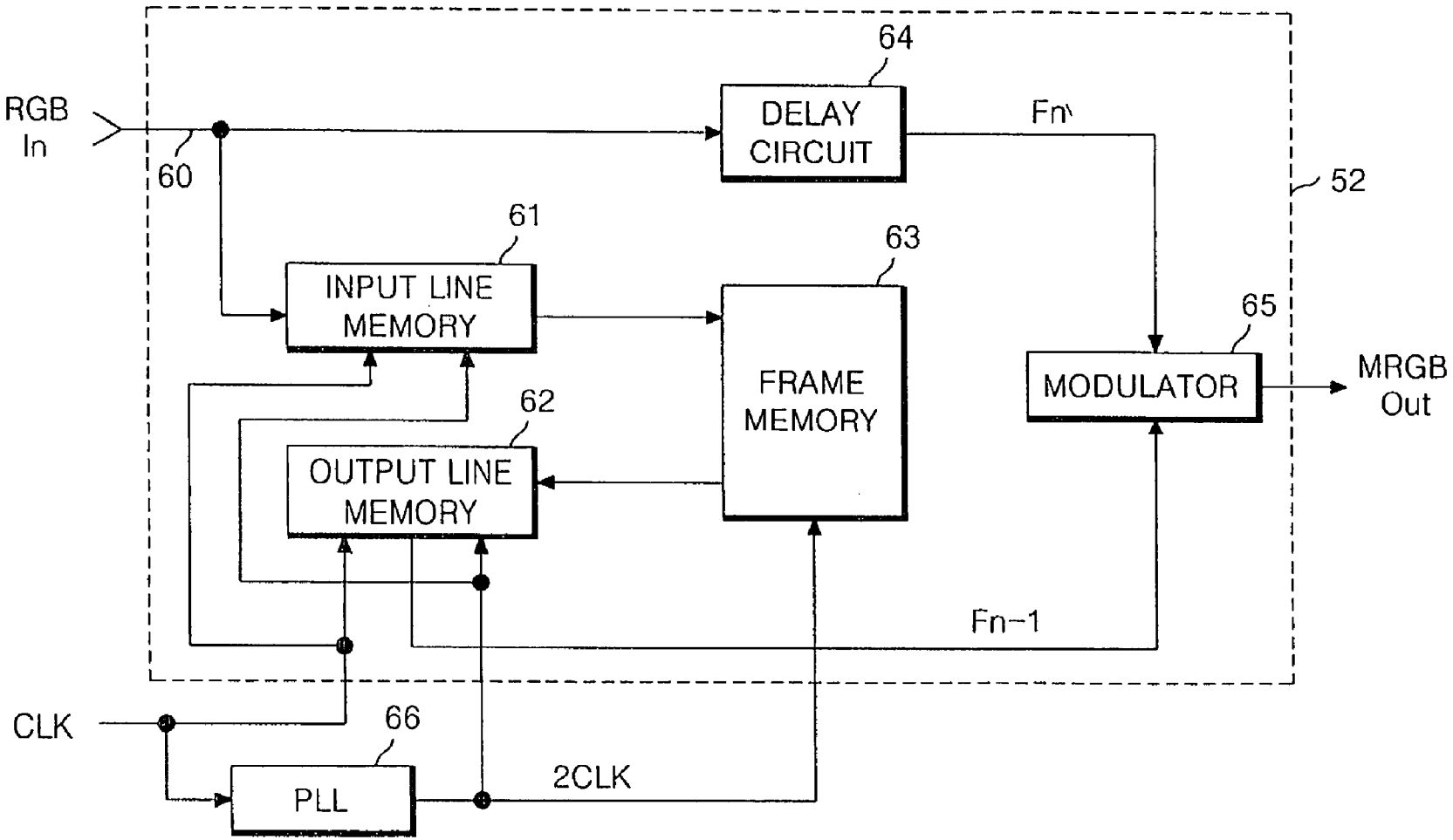
FIGS. 5 and 6 are detailed circuit diagrams that together represent a first exemplary embodiment of the modulator shown in FIG. 4.
Figure 6:
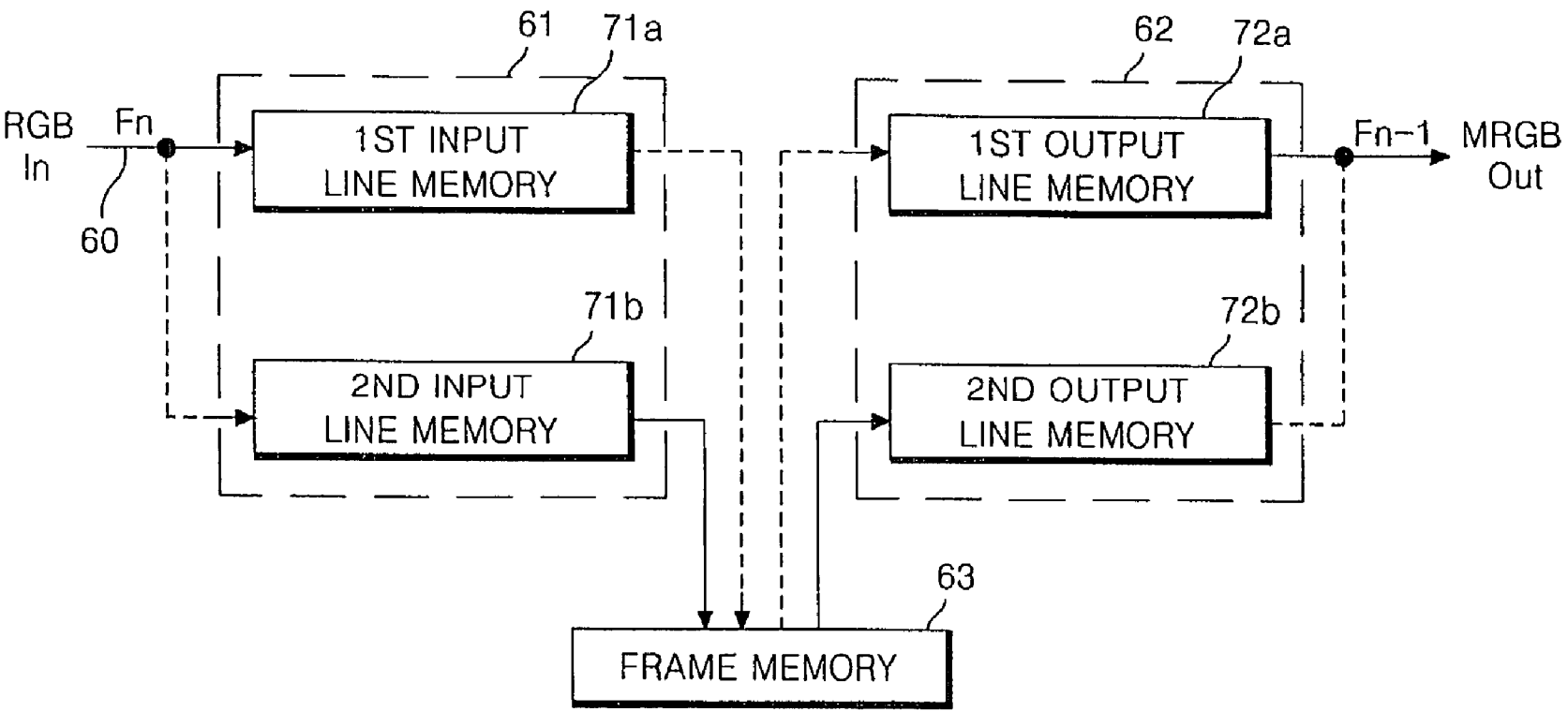

FIGS. 5 and 6 represent a first exemplary embodiment of the modulating part 52.

Referring to FIGS. 5 and 6, a liquid crystal display device according to the systems and methods of the present invention further includes a phase lock loop (PLL) 66 for multiplying the frequency of the pixel clock CLK. The modulating part 52 includes an input line memory 61, an output line memory 62, a frame memory 63, a modulator 65 and a delay circuit 64.

The PLL 66 multiplies the frequency of the pixel clock CLK to generate a "double" pixel clock 2CLK having a frequency twice as high as the frequency of the pixel clock CLK. The PLL 66 may be replaced as a PLL in the timing controller 51 or may be implemented with a separate PLL circuit, so that the PLL 66 is separated from the timing controller 51 or is additionally installed in the timing controller 51.

The input line memory 61 stores data of the current frame Fn, at the one-pixel clock rate according to the pixel clock CLK, and supplies the stored data at a two-pixel clock rate according to the double pixel clock 2CLK, to the frame memory 63. The input line memory 61 includes a first input line memory 71*a* and a second input line memory 71*b* in which the data from the data input line 60 is alternately stored at the speed of one-pixel clock rate for one line unit, and the stored data is supplied at the speed of the two-pixel clock rate to the frame memory 63, as shown in FIG. 6.

The frame memory 63 stores the current frame data Fn from input line memory 61 at the speed of the two-pixel clock rate, according to the double pixel clock 2CLK, and supplies the previous stored frame data Fn−1 to the output line memory 62 at the two-pixel clock rate.

The output line memory 62 stores the previous frame data Fn−1 from the frame memory 63 at the two-pixel clock rate, according to the double pixel clock 2CLK, and supplies the data stored at the one-pixel clock rate to the modulator 65. The output line memory 62 includes a first output line memory 72*a* and a second output line memory 72*b* in which data from the frame memory 63 is alternately stored at the two-pixel clock rate for one line unit and the stored data is supplied at the one-pixel clock rate to the modulator 65, as shown in FIG. 6.

The modulator 65 compares the current frame data Fn from the delay circuit 64 with the previous frame data Fn−1 from the output line memory 62 and selects an MRGB modulation data satisfying the Formulas 3 to 5 pursuant to the comparison result. Also, the modulator 65 supplies the selected MRGB modulation to the data driver 53.

The delay circuit 64 delays the current frame data Fn from the data input line 60 by a delay value identical to the delay of the previous frame data Fn−1 delayed in the input line memory 61 and the output line memory 62, to thereby synchronize the previous frame data Fn−1 and the current frame data Fn provided from the modulator 65. Because the previous frame data Fn−1 is delayed for two line periods by the input line memory 61 and the output line memory 62, a delay value of the delay circuit 64 becomes two line periods. Thus, the delay circuit 64 may be implemented with two line memories.

Let's assume that k-number of horizontal lines exists on the liquid crystal display panel 57, and a method of driving data among the memories 61, 62 and 63 will be described in conjunction with FIGS. 6 and 7.

Figure 7:
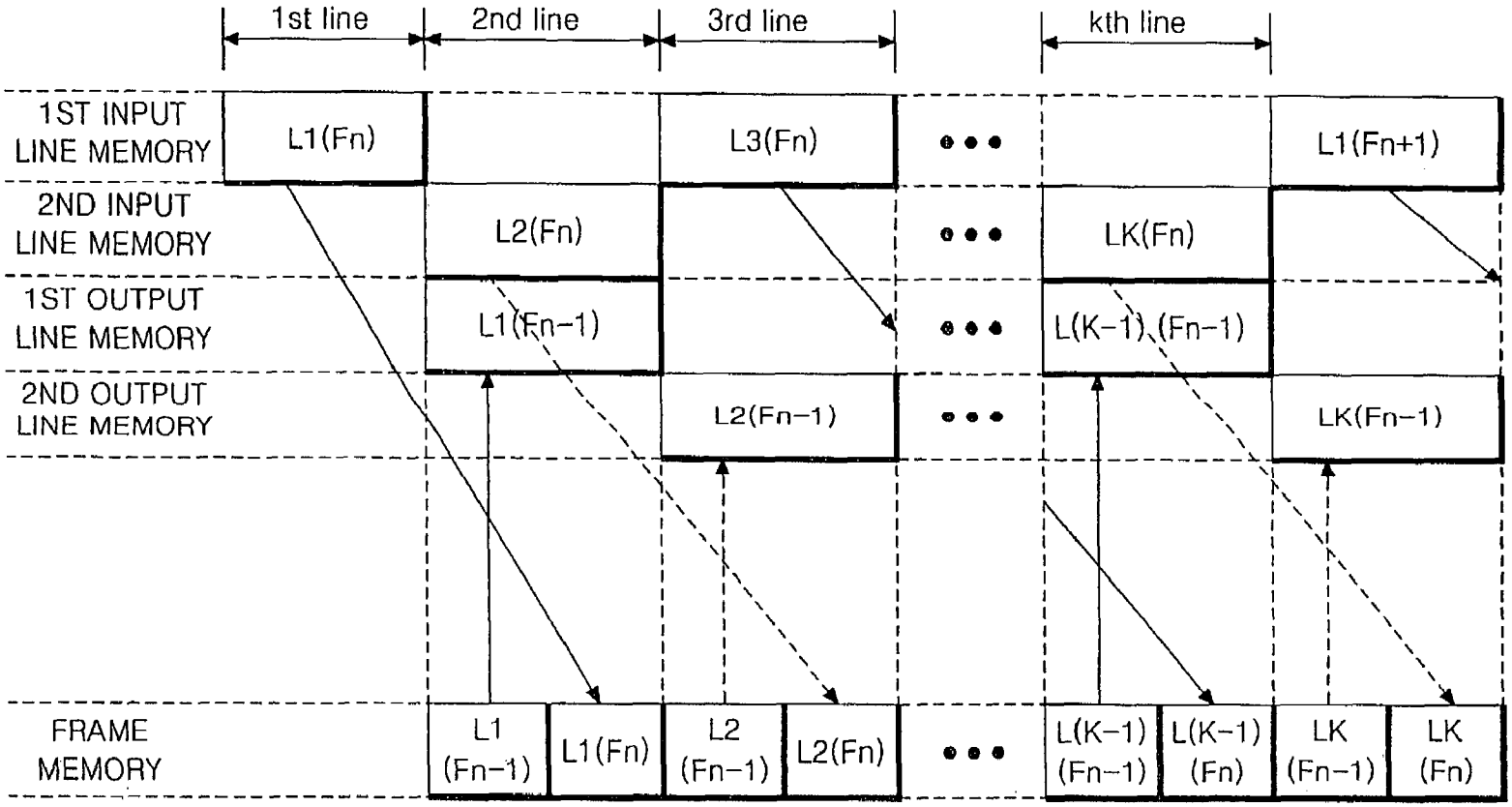
FIG. 7 is a configuration representing input/output of data in memories shown in FIG. 6.

Referring to FIGS. 6 and 7, during a first line period, the first input line memory 71*a* stores a first line data L1(Fn) of the current frame at a one-pixel clock rate.

During a second line period, the frame memory 63 supplies first line data L1(Fn−1) of the previous frame to the first output line memory 72*a* for an initial ½ period, and stores the first line data L1(Fn) of the current frame from the first input line memory 71*a* for another ½ period, at the two-pixel clock rate. During the second line period, the second input line memory 71*b* stores second line data L2(Fn) of the current frame at the one-pixel clock rate, and the first output line memory 72*a* stores the first line data L1(Fn−1) of the previous frame supplied from the frame memory 63 at the two-pixel clock rate and then supplies the data L1(Fn−1) to the modulator 65.

During a third line period, the frame memory 63 supplies second line data L2(Fn−1) of the previous frame to the second output line memory 72*b* for an initial ½ period and stores the second line data L2(Fn) of the current frame from the second input line memory 71*b* for another ½ period, at the two-pixel clock rate. During the third line period, the first input line memory 71*a* stores third line data L3(Fn) of the current frame at the one-pixel clock rate, and the second output line memory 72*b* stores the second line data L2(Fn−1) of the previous frame supplied from the frame memory 63 at the two-pixel clock rate and then supplies the data L2(Fn−1) to the modulator 65.

During a (k)th line period, i.e., the last line period in a one frame period, the frame memory 63 supplies a (k−1)th line data L(k−1) (Fn−1) of the previous frame to the first output line memory 72*a* for an initial ½ period and stores a (k−1)th line data L(k−1)(Fn) of the current frame from the first input line memory 71*a* for another ½ period, at the speed of two-pixel clock rate. During the (k)th line period, the second input line memory 71*b* stores a (k)th line data Lk(Fn) of the current frame at the one-pixel clock rate and the first output line memory 72*a* stores the (k−1)th line data L(k−1) (Fn−1) of the previous frame supplied from the frame memory 63 at the two-pixel clock rate and then supplies the data L(k−1) (Fn−1) to the modulator 65.

During the first line period of a next frame Fn+1, the frame memory 63 supplies a (k)th line data Lk(Fn−1) of the previous frame to the second output line memory 72*b* for an initial ½ period and stores the (k)th line data Lk(Fn) of the current frame Fn from the second input line memory 71*b* for another ½ period, at the two-pixel clock rate. During the first line period of the next frame Fn+1, the first input line memory 71*a* stores first line data L1(Fn+1) of the next frame Fn+1 at the one-pixel clock rate and the second output line memory 72*b* stores the (k)th line data Lk(Fn−1) of the previous frame Fn−1 supplied from the frame memory 63 at the two-pixel clock rate and then supplies the data Lk(Fn−1) to the modulator 65.

It is noted that a previous frame Fn−1 represents the frame corresponding to a previous screen of a screen being currently displayed in a liquid crystal display device and a current frame Fn represents the frame corresponding to a screen being currently displayed in a liquid crystal display device. Also, a next frame Fn+1 represents the frame corresponding to a next screen to be displayed after the screen being currently displayed.

Subsequently, the frame memory 63 reads out one line data of the current frame stored in the second input line memory 71*b* and supplies the stored one line data of the previous frame to the second output line memory 72*b*, at the two-pixel clock rate during each odd-numbered line period. Also, the frame memory 63 reads out one line data of the current frame stored in the first input line memory 71*a* and supplies the stored one line data of the previous frame to the first output line memory 72*a*, at the two-pixel clock rate during each even-numbered line period.

Figure 8:
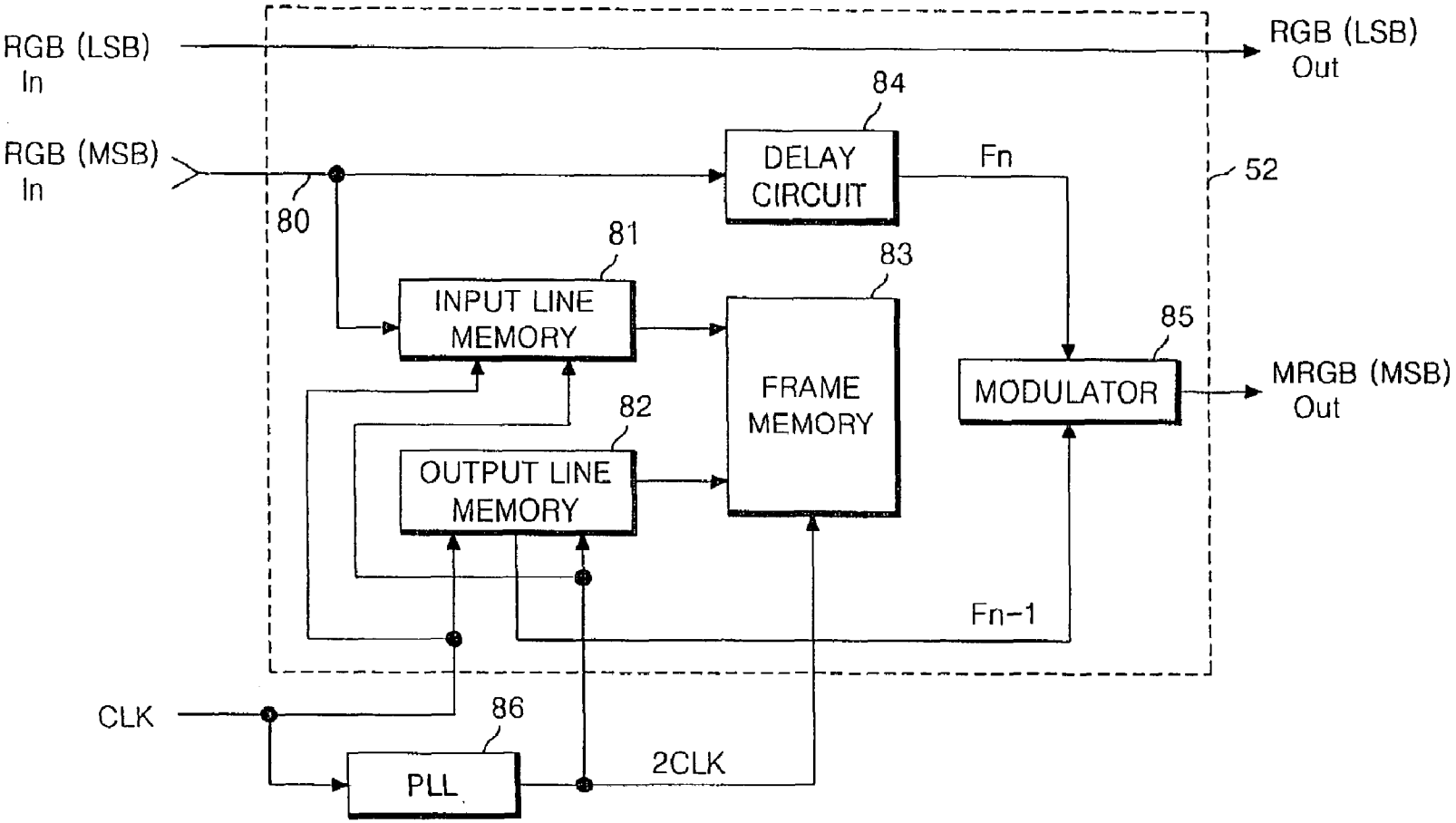
FIGS. 8 and 9 are detailed circuit diagrams that together represent a second exemplary embodiment of the modulator shown in FIG. 4.
Figure 9:
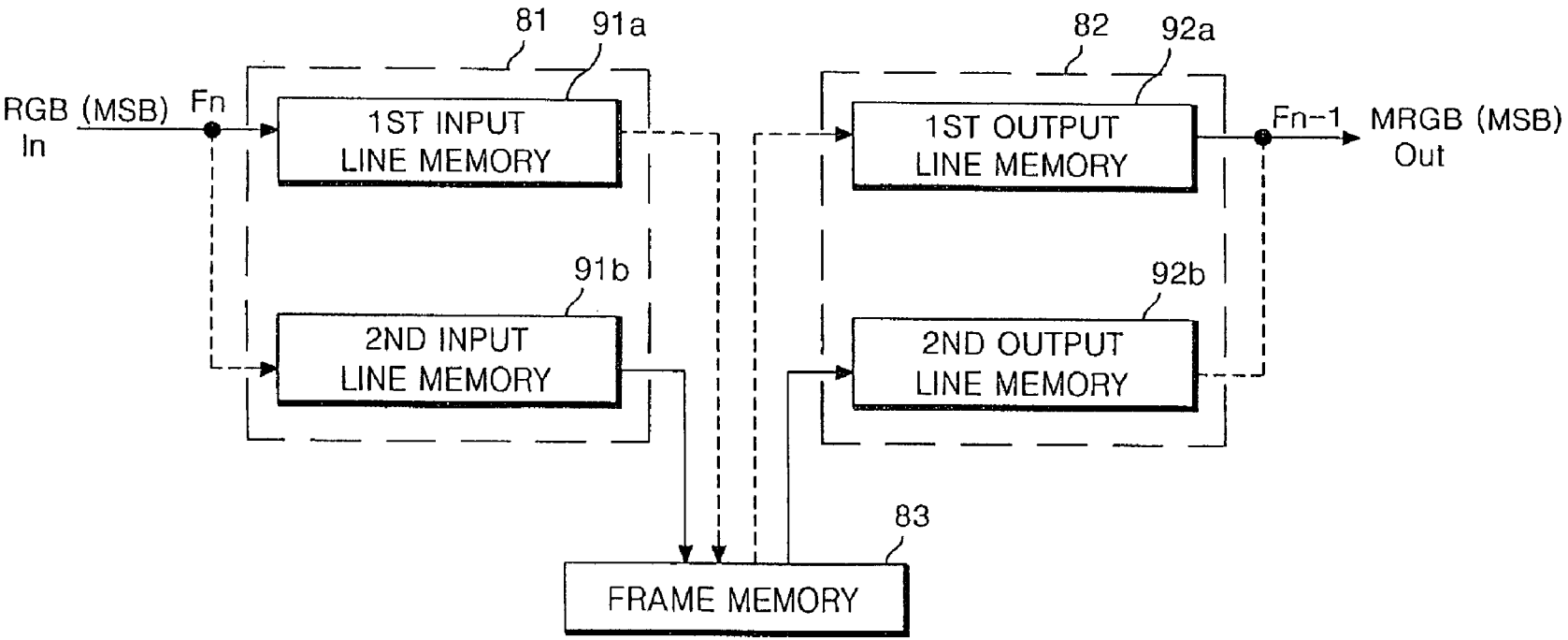

FIGS. 8 and 9 show a second exemplary embodiment of the modulation part 52. The second embodiment performs the operation for data comparison with the most significant bit unit, not full bit unit, and uses the bit number of MRGB modulation data as the number of most significant bit, and thus it is possible to reduce the capacitance of a frame memory and a memory in a modulator.

Referring to FIGS. 8 and 9, the modulation part 52 includes: an input line memory 81 for storing data at a one-pixel clock rate and outputting data at a two-pixel clock rate; an output line memory 82 for storing data at a two-pixel clock rate and outputting data by one-pixel clock rate; a frame memory 83 for storing and outputting data at a two-pixel clock rate; a modulator 85 for comparing the previous frame and the current frame by the most significant bit MSB data unit and modulating the current frame data; and a delay circuit 84 for synchronizing the previous frame data and the current frame data.

The PLL 86 shown FIG. 5 is substantially identical to that shown in FIG. 5, and therefore a detailed description of the PLL 86 will be omitted.

The input line memory 81 stores the most significant bit data Fn(MSB) of the current frame at a one-pixel clock rate according to the pixel clock, CLK, and supplies the stored data, according to the double pixel clock 2CLK, to the frame memory 83 at a two-pixel clock rate. The input line memory 81 includes a first input line memory 91*a* and a second input line memory 91*b* in which the data from the data input line 80 is alternately stored at the one-pixel clock rate for one line unit, and the stored data is supplied to the frame memory 83 at the two-pixel clock rate, as shown in FIG. 9.

The frame memory 83 stores the current frame data Fn from the input line memory 81 at the two-pixel clock rate, according to the double pixel clock 2CLK, and supplies the previous stored frame data Fn−1 to the output line memory 82 at the two-pixel clock rate.

The output line memory 82 stores the previous frame data Fn−1 from the frame memory 83 at the two-pixel clock rate, according to the double pixel clock 2CLK, and supplies the data stored at the one-pixel clock rate to the modulator 85. The output line memory 82 includes a first output line memory 92*a* and a second output line memory 92*b* in which the data from the frame memory 83 is alternately stored at the two-pixel clock rate for one line unit and the stored data is supplied at the one-pixel clock rate to the modulator 85, as shown in FIG. 9.

The modulator 85 compares the most significant bit Fn(MSB) of the current frame data from the delay circuit 84 and the previous frame data Fn−1 (MSB) from the output line memory 82 and selects an MRGB (MSB) modulation data satisfying the Formulas 3 to 5 pursuant to the result of the comparison.

The MRGB (MSB) modulation data selected by the modulator 85 is supplied to the data driver 53 along with the least significant data Fn(LSB) of the current frame.

The delay circuit 84 delays the current frame data Fn from the data input line 80 by a delay value identical to that of the previous frame data Fn−1 being delayed in the input line memory 81 and the output line memory 82, to thereby synchronize the previous frame data Fn−1 and the current frame data Fn provided from the modulator 85. Because the previous frame data Fn−1 is delayed for two line periods by the input line memory 81 and the output line memory 82, a delay value of the delay circuit 84 becomes two line periods. Thus, the delay circuit 84 may be implemented with two line memories.

Input and output operations of these memories are substantially identical to those shown in FIG. 7, and therefore detailed explanations of them will be omitted.

As described above, a method and an apparatus for driving a memory of a liquid crystal display device is capable of increasing the response speed of a liquid crystal material, which becomes fast through the use of a data modulation, and, thus, it is possible to improve display quality and reduce the number of frame memories to reduce circuit expense.

Although the present invention has been explained with respect to the exemplary embodiments shown in the drawings described above, it should be understood to the ordinary skilled person in the art that the systems and methods of the invention are not limited to the exemplary embodiments, but rather that various changes or modifications thereof are possible without departing from the spirit of the invention. Accordingly, the scope of the invention shall be determined only by the appended claims and their equivalents.

What is claimed is:

1. A method of driving a memory in a liquid crystal display device comprising:

storing current frame data in an input line memory at a first speed;

reading the current frame data the input line memory at a second speed faster than the first speed, and storing the current frame data read from the input line memory in a frame memory at the second speed;

reading a previous frame data stored in the frame memory at the second speed, and storing the previous frame data read from the frame memory in an output line memory at the second speed;

reading the previous frame data stored in the output line memory at the first speed;

comparing the current frame data with the previous frame data read from the output line memory at the first speed; and selecting a predetermined modulation data in accordance with the result of the comparison, wherein storing the current frame data in the input line memory by the first speed comprises:

storing an odd-numbered line data of the current frame data in a fist input line memory at the first speed during an odd-numbered line period, and storing an even-numbered line data of the current frame data in a second input line memory at the first speed during an even-numbered line period, and wherein storing the current frame data stored in the input line memory by the second speed in the frame memory includes:

storing the odd-numbered line data of the current frame data stored in the first input line memory in the frame memory during a ½ period of the even-numbered line period; and storing the even-numbered line of the current frame data stored in the second input line memory of the frame memory during a ½ period of the odd-numbered line period.

2. The method of claim 1, wherein the first speed is a one-pixel clock rate and the second speed is a two-pixel clock rate which is twice as high as the rate of the one-pixel clock rate.

3. The method of claim 1, wherein storing the previous frame data read from the frame memory in the output line memory by the second speed includes:

storing the odd-numbered line data of the previous frame data, stored in the frame memory, in the first output line during even-numbered line period; and storing the odd-numbered line data of the previous frame data, stored in the frame memory, in the second output line during even-numbered line period.

4. The method of claim 1, further comprising synchronizing the current frame data and the previous frame data by delaying the current frame data.

5. An apparatus for driving a memory in a liquid crystal display device, comprising:

an input line memory for storing current frame data at a first speed and outputting the stored data at a second speed faster than the first speed;

an output line memory for storing previous frame data at the second speed and outputting the stored data at the first speed;

a frame memory for storing the current frame data from the input line memory at the second speed and supplying the previous frame data to the output line memory at the second speed; and a modulator for comparing the current frame data with the previous frame data from the output line memory and selecting predetermined modulation data in accordance with the result of the comparison, wherein the input line memory includes:

a first input line memory for storing an odd-numbered line data of the current frame data at the first speed during an odd-numbered line period and supplying the odd-numbered line data of the current frame data at the second speed to the frame memory during a ½ period of an even numbered line period; and a second input line memory for storing an even numbered line data of the current frame data at the first speed during the even-numbered line period and supplying the even-numbered line data of the current frame data at the second speed to the frame memory during a ½ period of the odd-numbered line period; and wherein the output line memory includes:

a first output line memory for storing the odd numbered line data of the previous frame data at the second speed during the even-numbered line period and supplying the stored odd-numbered line data of the previous frame data at the first speed to the modulator; and a second output line memory for storing the even numbered line data of the previous frame data at the second speed during the odd-numbered line period and supplying the stored even-numbered line data of the previous frame data at the first speed to the modulator.

6. The apparatus of claim 5, wherein the first speed is a one-pixel clock rate and the second speed is a two-pixel clock rate which is twice as high as the rate of the one-pixel clock rate.

7. The apparatus of claim 6, further comprising a frequency multiplier for multiplying a pixel clock of the one-pixel clock rate to generate a two-pixel clock rate having a frequency higher twice than the rate of the one-pixel clock.

8. The apparatus of claim 5, wherein the first and the second input line memories alternately input/output the data.

9. The apparatus of claim 5, wherein the first and the second output line memories alternately input/output the data.

10. The apparatus of claim 5, further comprising a delay circuit for delaying the current frame data to synchronize the frame data and the previous frame data.

* * * * *